US005146640A

United States Patent [19]

Barton et al.

[11] Patent Number: 5,146,640

[45] Date of Patent: Sep. 15, 1992

[54] LATCHING ASSEMBLY FOR A CONVERTIBLE SOFA BED

[75] Inventors: Mark S. Barton, Black River Falls; Kurt J. Bandach, Stanley; Mark E. Schlichter, Beloit, all of Wis.

[73] Assignee: August Lotz Co., Inc., Boyd, Wis.

[21] Appl. No.: 783,682

[22] Filed: Oct. 29, 1991

[51] Int. Cl.[5] ..... A47C 17/17; A47C 17/16

[52] U.S. Cl. ..... 5/47; 5/37.1

[58] Field of Search ..... 5/47, 37.1, 41, 147; 297/354

[56] References Cited

U.S. PATENT DOCUMENTS

| | | | |
|---|---|---|---|
| 4,829,61 | 5/1889 | Fireman et al. | 5/47 |
| 835,770 | 11/1906 | Williams . | |
| 2,324,675 | 7/1943 | Burton | 5/37.1 |
| 2,343,642 | 3/1944 | Burton | 5/37.1 |
| 3,634,893 | 1/1972 | Hern | 5/47 |
| 4,875,244 | 10/1989 | Tremblay | 5/47 |

*Primary Examiner*—Alexander Grosz
*Attorney, Agent, or Firm*—Richard C. Litman

[57] ABSTRACT

A convertible sofa which is convertible to provide a sofa or a bed. The convertible sofa has a seat which is hinged to a back and supported by a frame. A pivoting pawl having a tapered edge is attached to the seat near the hinged point. Moreover, a step is provided on the back near the hinge which accepts the pawl when the seat is raised. For example, beginning with the convertible sofa in the bed position, lift the front of the seat. As the front of the seat is lifted, the gravitational force influences the pawl to hang in a downward direction. The pawl pivots until the tapered edge makes contact with the step. Once contact is achieved, pressing down on the seat creates a tension between the step and the pawl. By continuing to apply leverage to the seat, the back advances upward forming the sofa configuration. To disengage the pawl from the step, on the front edge of the seat thereby is lifted, relieving the stress on the pawl thus allowing the pawl to freely swing downward loosing contact with the step. The relationship of the step and the tapered edge on the pawl provides a unique readily releasable latch configuration.

6 Claims, 2 Drawing Sheets

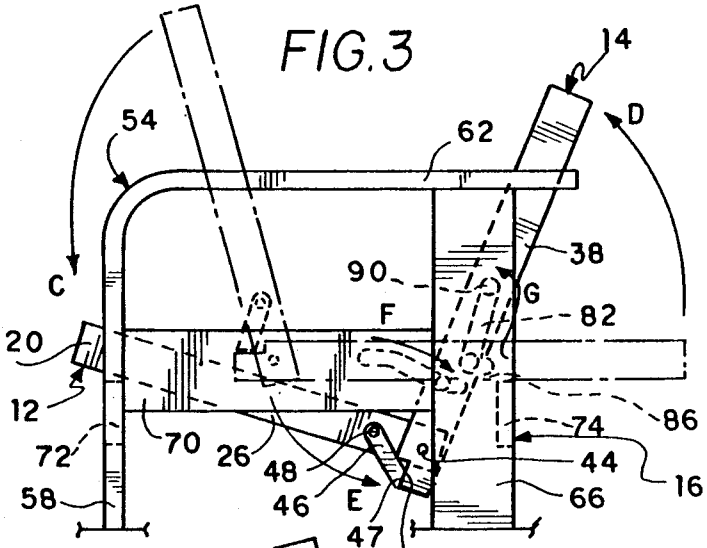
FIG. 3
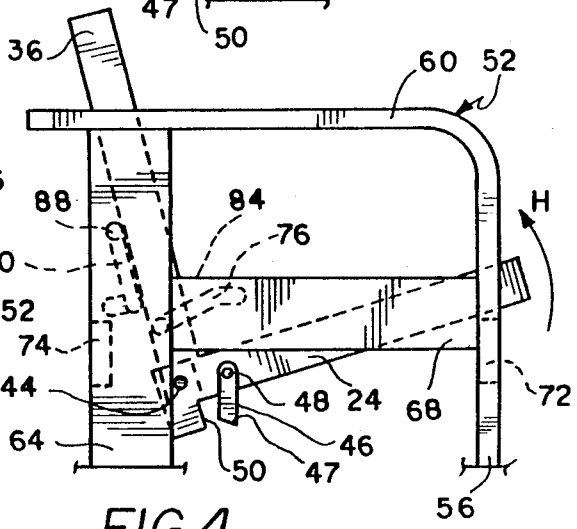
FIG. 4
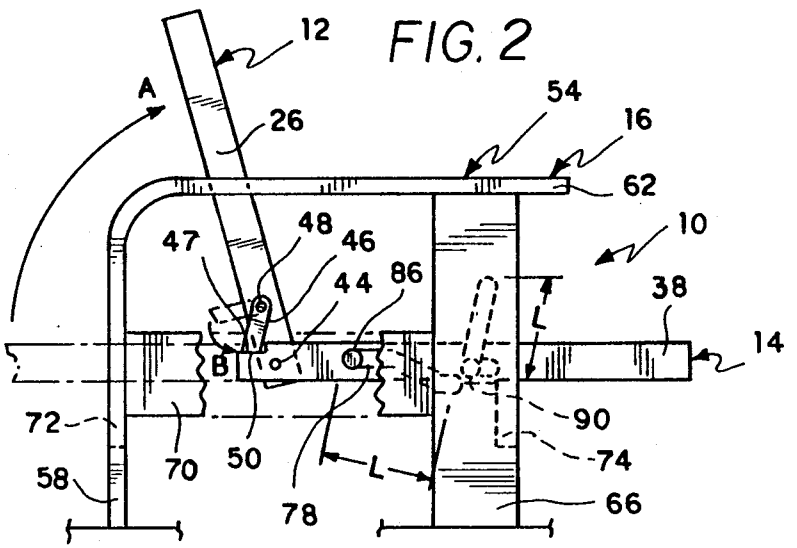
FIG. 2
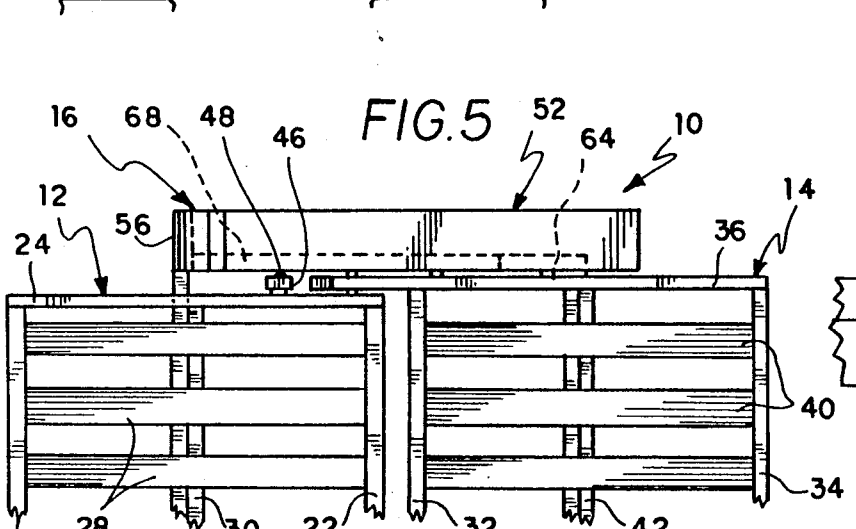
FIG. 6
FIG. 5

LATCHING ASSEMBLY FOR A CONVERTIBLE SOFA BED

BACKGROUND OF THE INVENTION

1. Field of the Invention

The present invention relates to a latching assembly for a convertible sofa bed.

2. Description of Prior Art

There exists an apparent appreciation for furniture of the combination type. Economy of space is essential if one inhabits an area where space is limited. A single piece of furniture capable of being converted to two or more different pieces, each piece providing a different function, offers a reduction in space consumption in comparison to the number of separate items that would be required to perform each individual function. Moreover, financial resources govern ones purchasing power requiring a decision to be made between rudimentary pieces of furniture. A single article which would function as more than one piece of furniture could remedy such decisions. It is for these reasons among others that the convertible sofa is well known and quite popular.

U.S. Pat. No. 835,770 issued Nov. 13, 1906 to Lawrence Williams shows a convertible couch and bed having a beveled latch releasing device.

U.S. Pat. No. 2,343,642 issued Mar. 7, 1944 to Robert Allen Burton shows pivotally connected seat and back sections of a sofa bed mounted on a bed frame.

U.S. Pat. No. 2,324,675 issued Jul. 20, 1943 to Robert Allen Burton shows a hinge construction for pivotally connecting seat and back sections of a sofa bed.

U.S. Pat. No. 3,634,893 issued Jan. 18, 1972 to John F. Hern et al. shows a sofa bed assembly which includes a cam rotatably connected to the seat frame for latching and unlatching under the force of gravity the assembly into a sofa or bed position.

U.S. Pat. No. 4,829,611 issued May 16, 1989 to Robert Fireman shows a sofa bed recliner which includes an automatically releasable detent. The detent disclosed in this patent has a flat end which engages the detent perpendicular to the frame of the back.

U.S. Pat. No. 4,875,244 issued Oct. 24, 1989 to Gilles Tremblay shows a sofa bed having a detent interlocking to provide a sofa and releasable to provide a bed.

None of the above inventions and patents, taken either singly or in combination, is seen to describe the instant invention as claimed.

SUMMARY OF THE INVENTION

The present invention relates to a convertible sofa or the like. The convertible sofa includes a seat, a back, and a frame to support the seat and the back. The convertible sofa provides a readily releasable latch assembly which includes a pivoting pawl having a tapered edge engagable and disengagable with a step. The seat and back are joined together by a hinge mechanism. With the seat and back in a horizontal plane, a bed configuration is achieved. To establish a sofa, simply raise the seat by lifting up on the front of the seat as the seat pivots on the hinge mechanism until the pawl pivoted on the seat frame engages in the step disposed on the back frame. Because the pawl has a tapered edge and the back frame includes a step, the engagement of the latch assembly offers little resistance. With the pawl engaged in the step, the seat is pushed down. As the seat is pushed down, the back will raise up and move forward providing a sofa. To disengage the pawl from the step, the front portion of the seat is raised. Again, since the pawl has a tapered edge and the back frame provides a step, the latch assembly easily disengages. With the pawl disengaged, the seat and back are lowered back to the horizontal position to once more provide the bed arrangement. The tapered pawl and the step provide a unique latch assembly not found in any of the patents cited above which promotes a nonresistant engagement and disengagement of the pawl and step.

Accordingly, one object of the present invention is to provide a convertible sofa which alternatively provides a bed arrangement and a sofa arrangement.

Another object of the present invention is to provide a readily releasable latch assembly which supports a distinctive unrestrained latch engagement and disengagement.

A further object of the present invention is to provide a sofa which is substantially effortlessly convertible to a bed and likewise, back to a sofa.

These and other objects of the present invention will become readily apparent upon further review of the following specification and drawings.

BRIEF DESCRIPTION OF THE DRAWINGS

FIG. 2 is a partially broken side elevational view of the present invention showing the seat being raised in phantom to engage the latch assembly.

FIG. 3 is a side elevational view of the present invention showing the back being raised as the seat is lowered to form a recliner.

FIG. 4 is a side elevational view of the present invention showing the latch assembly disengaging when the back is moved forward.

FIG. 5 is a partial top plan of the present invention in the bed position.

FIG. 6 is a partial rear view of the present invention in the bed position.

Similar reference characters denote corresponding features consistently throughout the attached drawings.

DETAILED DESCRIPTION OF THE PREFERRED EMBODIMENT

Figure 1:
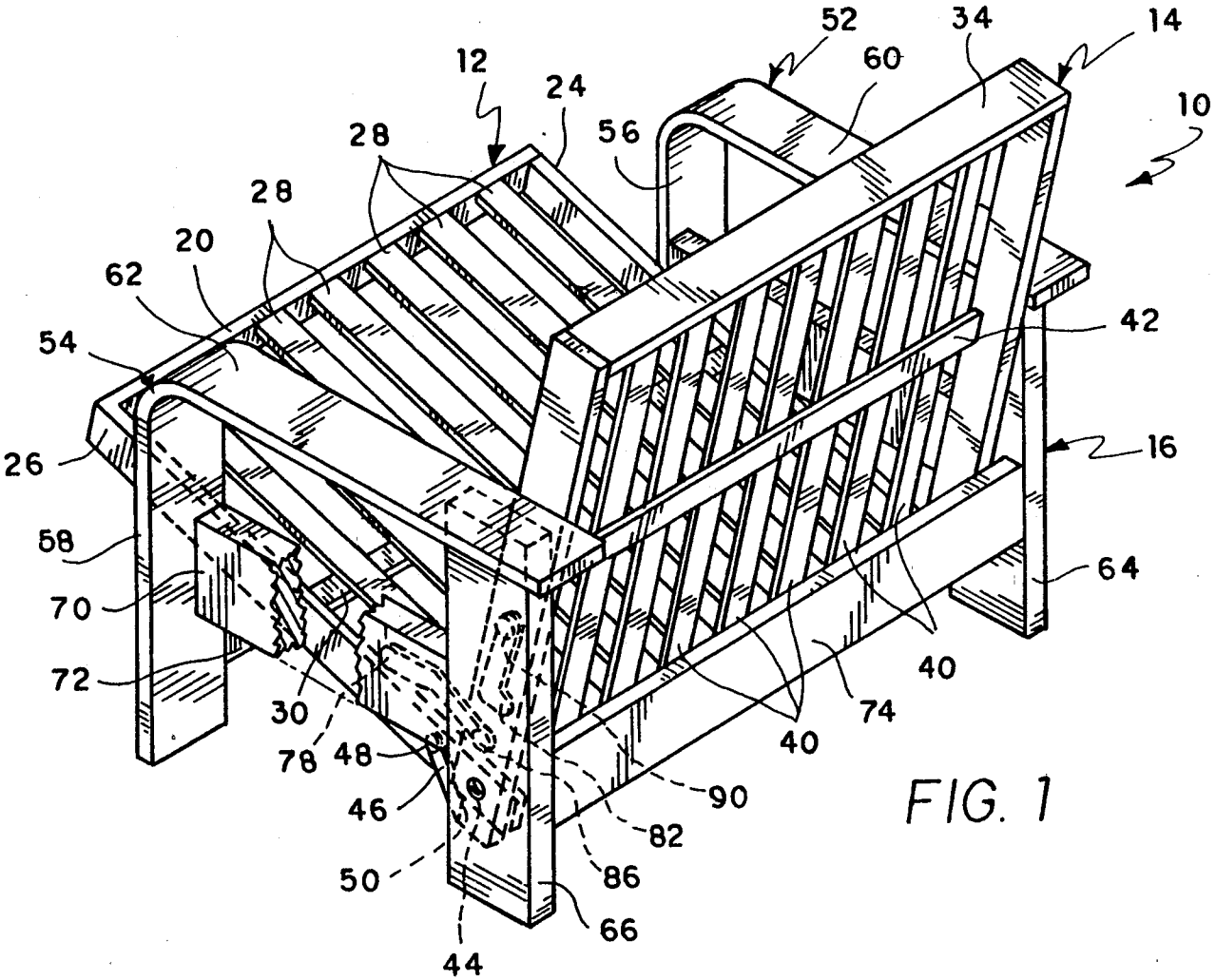
FIG. 1 is a partially broken perspective view of the present invention.

The drawing, referring to FIG. 1, shows the convertible sofa 10 in an upright position. The sofa bed 10 includes a seat 12, a back 14, and a frame 16 to support the seat 12 and the back 14.

With reference to FIGS. 1–6, the seat 12 includes a front crossbar 20, a rear crossbar 22, a right side 24, a left side 26, a plurality of slats 28, and a cross brace 30 to provide supplemental support for the slats 28. Similarly, the back 14 includes a front crossbar 32, a rear crossbar 34, a right side 36, a left side 38, a plurality of slats 40, and a cross brace 42 to provide supplemental support for the slats 40. The right and left sides 36, 38 of the back 14 adjacent the front crossbar 32 overlap the right and left sides 24,26 of the seat 12 adjacent the rear crossbar 22, respectively, and are pinned by a dowel 44 to form an unitary pivoting structure.

The frame 16 supports the seat 12 and the back 14. The frame 16 encompasses a right side 52 and a left side 54. The frame 16 incorporates a right and left front leg 56,58 which are integrally joined to a right and left armrest 60,62, respectively. The rear portion of the right armrest 60 is attached to and supported by a right rear leg 64. Likewise, the rear portion of the left armrest 62 is attached to a left rear leg 66. The right and left front legs 56,58 are secured to the right and left rear legs 64,66 by right and left longitudinal supports 68,70, respectively. The right and left sides of the frame 16 are joined at the front by a front cross support 72 and joined at the rear by a rear cross support 74.

The right and left sides of the frame 16 each contain a first track 76,78 and a second track 80,82, respectively. The first tracks 76,78 are each substantially horizontal and the second tracks 80,82 are each substantially vertical. Moreover, the first tracks 76,78 and the second tracks 80,82 are essentially the same length L. The right and left sides 36,38 of the back 14 each have a first peg 84,86 and a second peg 88,90. The first peg 84,86 is engagable in the first track 76,78 and likewise, the second peg 88.90 is engagable in the second track 80,82.

In FIG. 2, it is shown that the front cross support 72 provides vertical support for the seat 12 when the seat 12 is in the horizontal position and the rear cross support 74 provides vertical support for the back 14 when the back 14 is in the horizontal position. In addition, the first track 76,78 and the second track 80,82 also provide vertical support for the back 14 when the back 14 is in the horizontal position.

The right and left sides 24,26 of the seat 12 each include a pawl 46, adjacent the rear crossbar 22, which pivots on a pin 48. The right and left sides 36,38 of the back 14 each include a step 50 adjacent the front crossbar 32. The pawl 46 is free swinging to engage and to disengage with the step 50 by maneuvering the seat 12 and the back 14. The pawl 46 has a tapered edge 47. It is this differentiating combination of the tapered edge 47 and the step 50 which permit the pawl 46 and the step 50 to easily engage and disengage.

As illustrated in FIGS. 2 and 3, when the seat 12 is lifted in the direction A, the pawl 46 swings in the direction B pivoting under the influence of the gravitational force to engage in the step 50. With the pawl 48 engaged in the step 50, the seat 12 is lowered in the direction C raising the back 14 in the direction D and providing a displacement in the direction E of the hinged area of the seat 12 and the back 14. With the sofa 10 in this reclined position, the first peg 84,86 has moved in the direction F to provide both horizontal and vertical support while the second peg 88,90 has moved in the direction G continuing to provide horizontal support.

FIG. 4 shows how to restore the convertible sofa 10 to a bed position. Merely lift the seat 12 up in the direction H and the pawl 46 will disengage from the step 50 and the back 14 will lower returning the seat 12 and the back 16 to the horizontal position.

It is to be understood that the present invention is not limited to the sole embodiment described above, but encompasses any and all embodiments within the scope of the following claims.

We claim:

1. A convertible sofa comprising:

a seat, a back, a frame which supports said seat and said back, said frame providing means to slidably attach said seat and said back to said frame, means to join said seat and said back, said means to join providing a movable joint between said seat and said back, a readily releasable latch assembly including a pivotal pawl having a tapered edge, said pawl being pivotally connected to said seat, said tapered edge being engagable and disengagable with a step located on said back to form an alternative sofa and bed, whereby when said convertible sofa is in a bed position, said seat is lifted to engage said pivotal pawl with said step and thereafter lowering said seat raises the back to thereby form a sofa and when said convertible sofa is in a sofa position the seat is thereafter slightly lifted to disengage said readily releasable latch with substantially no resistance, whereby said seat and back may be lowered to form said bed.

2. The device according to claim 1, wherein said seat and said back each have a top and each said seat and said back include a front cross bar and a rear cross bar joined at right angles to a right side and a left side, a plurality to slats having a bottom surface being disposed within and adjacent said top and being attached perpendicular to said front and said rear cross bars, and a cross brace being attached perpendicular to said right and left sides juxtaposed to said bottom surface of said plurality of slats providing supplemental support for said plurality of slats.

3. The device according to claim 2, wherein said right and left sides of said back adjacent said front cross bar of said back overlap said right and left sides of said seat adjacent said rear cross bar of said seat, respectively, and are pinned by a dowel to form a unitary pivotal structure, forming said means to join said seat and said back.

4. The device according to claim 3, wherein said right and said left side of said seat include said pivotal pawl which pivots on a pin, and said right and left side of said back having said top include a step adjacent said top of said back near said dowel, whereby said pivotal pawl is engaged with said step when said back is in a horizontal position by lifting up on said front cross bar of said seat and raising said seat until said pivotal pawl makes contact with said step under the influence of gravitational force, and by applying leverage to lower said seat down to said front cross support said back is raised and moved forward to form said sofa, and said pivotal pawl and said step being disengaged by a slight raising of said front of said cross bar of said seat thereby relieving tension imposed on said pivotal pawl by said step and thereafter pulling forward on said seat said seat and said back into a horizontal position.

5. The device according to claim 2, wherein said frame includes a right and a left side each comprising an armrest having a front and rear end, said front end of each said armrest being integrally joined to a front leg substantially at a right angle, said rear end of each said armrest being joined substantially at a right angle to a rear leg, and each said side of said frame further including a longitudinal support being joined substantially perpendicular to said front leg and extending and being joined substantially perpendicular to said rear leg to add structural integrity to said frame, said right side of said frame and said left side of said frame each having a front and a rear end joined together respectively by a front and rear cross support each having two ends, one of said ends of said cross support being attached perpendicular to said right side of said frame and one of said ends of said cross support being attached perpendicular to said left side of said frame, said cross supports extending from said right side of said frame to said left side of said frame whereby said front cross support of said frame also providing vertical support for said seat and rear cross support of said frame also providing vertical support for said back.

6. The device according to claim 5, wherein said right side and said left side of said frame each include a first and second track, said first track is substantially horizontal and said second track is substantially vertical and said right side and said left side of said back include a first and second peg which mate respectively with said first and second track providing said means to slidably attach said seat and said back to said frame whereby said first track provides continuous vertical support for said seat and said second track provides vertical support for said back when said back is in a horizontal position.

* * * * *